US005168916A

United States Patent [19]

Doriath et al.

[11] Patent Number: 5,168,916

[45] Date of Patent: Dec. 8, 1992

[54] FOUNDRY INSTALLATION FOR THE FABRICATION OF CAST METAL PARTS WITH AN ORIENTED STRUCTURE

[75] Inventors: Jean-Claude Doriath, Eragny sur Oise; Georges M. C. A. Gauje, Saulx les Chartreux; Jacques L. E. Grammagnac, Crisenoy, all of France

[73] Assignee: Societe Nationale d'Etude et de Construction de Moteurs d'Aviation, Paris, France

[21] Appl. No.: 54,150

[22] Filed: Jun. 22, 1979

[30] Foreign Application Priority Data

Jun. 30, 1978 [FR] France ..... 78 19567

[51] Int. Cl.[5] ..... G22D 27/04

[52] U.S. Cl. ..... 164/338.1; 164/122.1; 164/348

[58] Field of Search ..... 164/121, 122, 338, 322, 164/323, 259, 415, 417, 122.1, 338.1, 348

[56] References Cited

U.S. PATENT DOCUMENTS

| | | | |
|---|---|---|---|
| 2,218,171 | 10/1940 | Junghans | 164/322 |
| 2,796,644 | 6/1957 | Kuhn | 164/259 |
| 3,519,061 | 7/1970 | Dunlop | 164/121 |
| 3,895,672 | 7/1975 | King et al. | 164/322 |
| 3,897,815 | 8/1975 | Smashey | 164/338 |
| 4,175,610 | 11/1979 | Zauhaur et al. | 164/322 |

*Primary Examiner*—Stephen J. Lechert, Jr.
*Attorney, Agent, or Firm*—Bacon & Thomas

[57] ABSTRACT

A foundry installation designed for the fabrication of metal parts with an oriented structure, the installation being of a type comprising a casting chamber communicating with a lock for the introduction and extraction of a mold, via a first opening sealable by a first airtight gate apparatus for casting and for cooling the mold placed in the chamber.

In accordance with the invention, the installation includes, in addition, a mold preheating and degassing chamber communicating with the lock via a second opening sealable by a second airtight gate.

18 Claims, 4 Drawing Sheets

FOUNDRY INSTALLATION FOR THE FABRICATION OF CAST METAL PARTS WITH AN ORIENTED STRUCTURE

BACKGROUND OF THE INVENTION

The invention concerns a foundry installation, designed in particular to produce metal parts with an oriented structure by directional solidification, in particular superalloy parts with a basaltiform, or columnar, structure, such as blades for turbines and turbojet engines. More precisely, the installation the subject of the invention makes it possible to realize the following cycle of operations: preheating and degassing of a parts mold, melting and casting of the alloy in the mold, holding the latter at the desired temperature during casting, controlled cooling of the mold to obtain directional solidification. All these operations are performed in a vacuum, or in a chemically neutral atmosphere, in order to avoid contamination of the alloy.

There already exist installations designed to realize this cycle of operations. One known installation of this type consists of a vacuum chamber surmounting a lock. This latter is closed by an airtight door, opening of which permits the extraction of a cast mold and the introduction of an empty mold. There is a mold passage opening in the horizontal wall separating the chamber from the lock, sealable by an airtight gate and providing for the passage of a cooled plate carried by a jack, actuated, like the gate, from outside the installation. The empty mold is introduced into the lock and placed on the plate, then is surmounted by a crucible containing the alloy to be cast. The chamber contains a vertical axis annular furnace. The rising movement of the plate permits introduction of the mold and crucible into the furnace. The latter is a dual-mode furnace, that is, it has two stages of heating, such that by changing the furnace mode, or by modifying the vertical position of the mold, it is possible to obtain preheating of the mold and melting of the alloy. There is an outlet hole in the bottom of the crucible. Changing the position of the crucible, or the melting of a safety (fusible) plug sealing the hole, will cause the alloy to pour into the mold when correct mold and molten alloy temperatures have been reached. Return of the mold into the lock, ensured by the descending motion of the cooled plate, results in the passage of the mold into an annular cooler placed under the furnace and surmounting the passage opening. The action of this cooler is added to that of the plate to ensure directed solidification. When the poured mold and the empty crucible are in the lock, the gate is closed and the change of mold and crucible can be made without breaking the vacuum in the chamber. An installation of this type can have several variants. For example, melting and casting the alloy can be ensured by a special furnace, a tilting furnace, for example, located in the chamber, the capacity of which is such that several molds can be cast, and the tilting of which is controlled from outside the chamber. The latter obviously must be fitted with an airtight door for use in charging the furnace.

An installation such as this will, once operational parameters have been developed, make it possible to obtain sound parts with the desired structure, but the production rate is necessarily limited by the duration of the cycle. Two obvious solutions already have been developed to accelerate this rate. The first consists in increasing the number of parts in the pattern grouping, if the parts can be cast in such a grouping. But this conflicts with the need to maintain the isothermal cooling surfaces as flat, and as horizontal as possible during solidification in order to prevent shrinkage cavities and microscopic shrinkage cavities, and to obtain the basaltiform, and columnar structure desired. This requirement imposes a particular limitation on the ratio of the transverse dimensions of the mold to its height, and, as a result, on the number of parts in a pattern grouping. The second solution is to increase the number of installations. These are expensive, however, because of the airtightness requirements and because of the reliability they must have. The investment required thus becomes considerable for other than a large series of such installations.

Meanwhile, it has been suggested, for purposes of realizing an automatic installation, that a number of solidification cells be installed in the same vacuum chamber, each consisting of a furnace to maintain mold temperature, an elevator plate, and a cooler. The cells are coupled to the wall of the chamber, which revolves and rotates. Chamber rotation brings each mold in succession under an outlet hole supplied with liquid metal by an outside melting installation. Placement, and withdrawal, of the mods is ensured by passages equipped with conveyers. Each of the admission passages has, if feasible, a mold preheating furnace and each extraction passage can include a mold cooler. An installation such as this is very complicated, highly mechanized, and very expensive, and can only be considered when fabrication is to be in a very big series. In addition, it has the major disadvantage that operating conditions must remain constant during the whole of the production sequence. In other words, it is impossible, once the fabrication sequence for a particular type part has begun, to proceed to tests to produce parts of another type, that is, of parts with a different shape, and/or, made of a different alloy.

SUMMARY OF THE INVENTION

The subject of the invention is a foundry installation of the type defined at the beginning of this description, and which responds simultaneously to the following requirements:

- ensure a rate of production appreciably greater than that of the simple installations of the type known;
- be itself of relatively simple design, and, as a result, of relatively moderate cost.

The invention is based on knowledge of the fact that the two longest operations in the fabrication cycle are, on the one hand, preheating and degassing of the mold, and, on the other, solidification by controlled cooling. The installation the subject of the invention makes it possible to present at least one mold to the first of these operations at the same time that another mold is presented to the second.

The installation of the invention, which includes, in a known way, a first airtight chamber designed for casting and fitted with means for atmosphere control, a mold temperature maintenance furnace located in the aforesaid chamber, means for casting the alloy, also located in the aforesaid chamber, a lock for the introduction and extraction of the mold, communicating with the outside via a first opening in the lock fitted with a first airtight door, and with the aforesaid chamber via a first mold passage opening sealable by a first airtight gate controlled from the outside, in short the first means of transfer, controlled from the outside, to transfer a mold from the lock through the aforesaid mold passage opening into the interior of the aforesaid heating furnace, and vice versa, is characterized by the fact that it comprises, in addition, at least a second airtight chamber designed for preheating the molds, and, as occasion warrants, for their degassing, and fitted with means for atmosphere control, a mold preheating furnace located in the aforesaid chamber, this communicating with a lock via a second mold passage opening, sealable by a second airtight gate controlled from the outside, in short, the second means of transfer, controlled from the outside, for transferring a mold from the lock to the interior of the aforesaid preheating furnace, and vice versa, through the aforesaid passage opening.

Here it should be understood that "means for atmosphere control" as well as the means (cylinders and admission pipes) for admission into each chamber of an atmosphere of definite composition and pressure, refers to the means (vacuum pumps and exhaust pipes, for example) required to create, and to maintain, a predetermined vacuum in the aforesaid chambers.

Of course, on the one hand the first mold transfer means can advantageously include a mold carrier plate that can be washed by a flow of refrigerant as the cooler contributing to the generation of the temperature gradient needed to control solidification, and, on the other hand, an annular cooler can be advantageously located in the first enclosed space between the heating furnace and the first passage opening to create a supplementary temperature gradient such as to associate the solidification rate, also called the progression of the solidification front, with the rate of descent of the mold through the annular cooler.

Then, too, as will be explained in the course of this description, it is advantageous, for purposes of facilitating and accelerating the cycle of fabrication operations, to divide the lock into two parts in communication via a third mold passage opening, sealable by a third gate controlled from the outside, that is, a first part of the lock, communicating with the first chamber via the first mold passage opening and with the outside via the first opening in the lock, and a second part of the lock, communicating with the second chamber via the second mold passage opening and with the outside via a second opening in the lock, it too being sealable by an airtight door.

It is, in short, advantageous to locate the said lock and the two chambers such that the latter surmount the lock regardless of whether or not the lock is divided into two parts, because this permits of great simplification in the realization of all the transfer means, because the heating and preheating furnaces will then be located above the corresponding passage openings.

There are several solutions to the means for casting the alloy.

These casting means, in the example to be described below, consist of a tilting melting furnace, the tilting of which is controlled from the outside, and which is located in the first chamber in a manner such that it can:

- be charged through a charging hole made in the first chamber, and is sealable by an airtight door;
- melt the alloy without loss;
- cast the alloy into a mold placed in the heating furnace.

This furnace can, however, also be a melting furnace with a bottom outlet. These heating means can be induction or electric-resistance.

It is also possible, within the framework of the present application, to constitute in known fashion the aforesaid melting means in the form of a crucible located above each mold, and heated by a temperature maintenance furnace, or even by a casting pipe with an airtight connection to an outside melting furnace.

BRIEF DESCRIPTION OF THE DRAWINGS

Other arrangements, and other advantages, of the invention will become apparent in the description of examples that follow, with reference to the attached drawings, in which.

DESCRIPTION OF THE PREFERRED EMBODIMENTS

The parts of the installation, and of the subassemblies, that perform the same functions are assigned the same reference number in the different figures.

Figure 1:
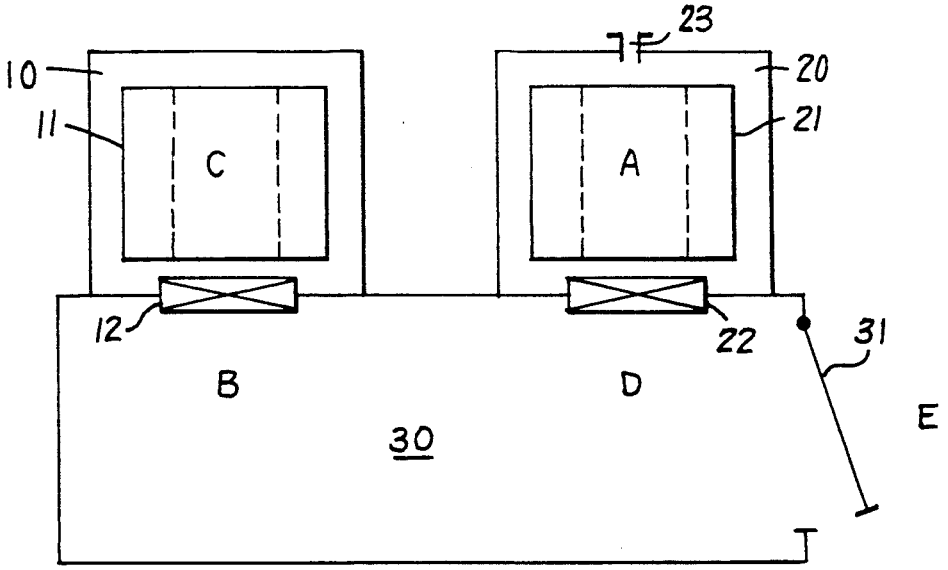
FIG. 1 is a schematic section in elevation of a first embodiment of the installation the subject of the invention.

First to be considered is FIG. 1. The preheating and degassing chamber, 10, which contains the mold preheating furnace 11, is located alongside the melting chamber 20, which contains the temperature maintenance furnace 21. The two chambers 10 and 20 surmount the lock 30. The latter can communicate: with the outside (E) via an opening for use in the introduction and extraction of the mold and is sealable by an airtight door 31; with chamber 10 via a mold passage opening that can be closed off by an airtight gate 12; and with chamber 20 via a mold passage opening that can be closed by airtight gate 22. Gates 12 and 22 obviously are controlled from the outside. Furnaces 11 and 21 are bottomless vertical axis annular furnaces so they can be located above gates 12 and 22, respectively, so molds can be introduced through the bottom. It is assumed that casing the mold in furnace 21 can take place by using pipe 23, which is connected to the outside melting means, not shown, and which emerges through the ceiling of chamber 20.

Figure 2:
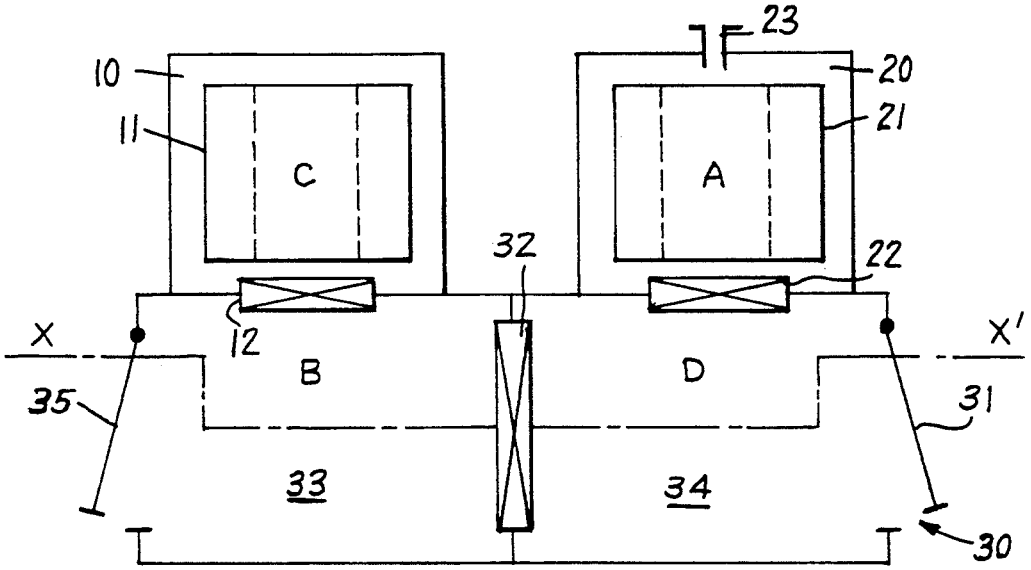
FIG. 2 is a schematic section in elevation of a second embodiment.

FIG. 1, like FIG. 2, while an incomplete diagrammatic representation, does illustrate the working of the corresponding fabrication cycle. These two figures do not show the outside remote control means, which will be described below, for transferring the molds between the lock and each chamber, and vice versa. Nor do they show the mold cooling means that makes it possible to ensure directed solidification during the descent of a cast mold passing through the opening gate 22, nor such of the accessories such as electrical connections, atmosphere control means, etc.

Returning to FIG. 1, let it be assumed that a first mold is already in (A), that is, in furnace 21, and is in the process of being cast. Door 31 and gates 12 and 22 are closed. For this purpose it is conceded that the mold is in this case supported in (A) by a device other than that of introduction through the base, not traversing gate 22. Door 31 then is opened and a second mold is introduced into lock 30 at (B), that is, under gate 12. Door 31 is closed, gate 12 is opened, the second mold is introduced into (C), that is, into furnace 11. Gate 12 is once again closed and gate 22 is opened. The second mold is now being heated and degassed in (C) at the same time that the first mold descends after it has been cast via the opening of gate 22 to be placed in (D). The cooling means, not shown, is operated during the descent. Once the first mold is in (D), gate 22 is once again closed and door 31 is opened to extract the first mold. Door 31 is closed once again, gate 12 is opened and the second mold descends to be transferred into space (B). Gate 12 is closed once again, whereupon gate 22 is opened to permit the placement of this second mold in (A), in furnace 21. Gate 22 then is closed once again, and door 31 is opened to permit the introduction of a third mold into lock 30 at (B). After door 31 is closed, gate 12 can be opened for the introduction of this third mold into (C), and so on.

The installation shown in FIG. 1 thus permits the effective cooling of another mold upon its exit from space (A) through open gate 22 when door 31 is closed, while a mold is being heated and degassed in space (C), closed by closed gate 12. It should be noted that these two operations are the longest in the cycle.

Figure 3:
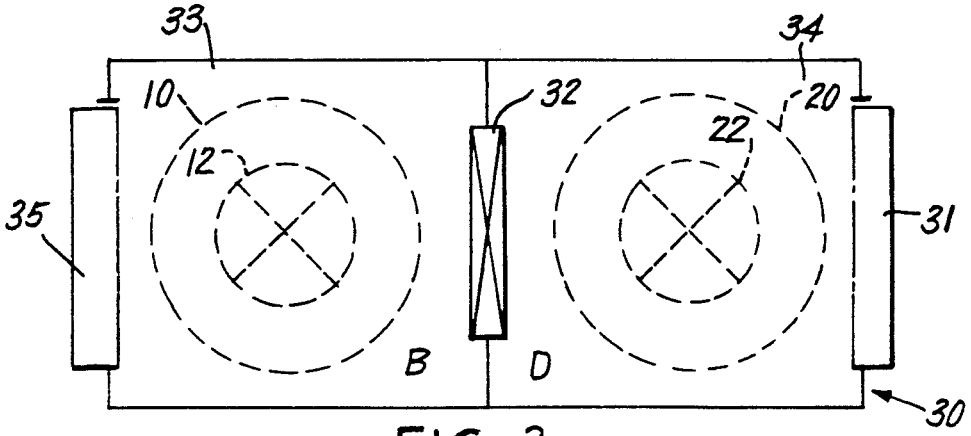
FIG. 3 is a section through horizontal planes x - x' of FIG. 2.

FIGS. 2 and 3 show a more advantageous approach to realization than that shown in FIG. 1. In the case of the installation in FIG. 1, lock 30 can only be occupied by one mold at a time, because leaving a preheated and degassed mold in lock 30 when door 31 is opened to permit the extraction of another cast and cooled mold present in the lock, is prohibited.

The installation shown in FIGS. 2 and 3 is identical with that shown in FIG. 1, except for the fact that it has, in addition, a mold passage gate 32, which, when closed, divides lock 30 into two lock parts 33 and 34, respectively, delimiting spaces (B) and (D), and an access door 35, located in the end of the lock opposite to that fitted with door 31. It thus is possible to place a mold in space (C), or to extract it at the same time that another mold is first withdrawn from space (A) after casting to undergo the cooling operation, and then removed through door 31. More generally, the presence of door 35, and of gate 32, means that preheating and degassing on the one hand, and casting and cooling on the other, are no longer interdependent. In addition, division of lock space 30 into two parts, within each of which it is possible to terminate atmosphere control pipes, reduces the volume of atmosphere to be exhausted and renewed after each closure of the door.

When the duration of the preheating and degassing operation is appreciably longer than that of the casting and cooling operations, the addition of a supplementary isolating gate in the lock makes it possible to take care of a supplementary preheating and degassing chamber.

Figure 4:
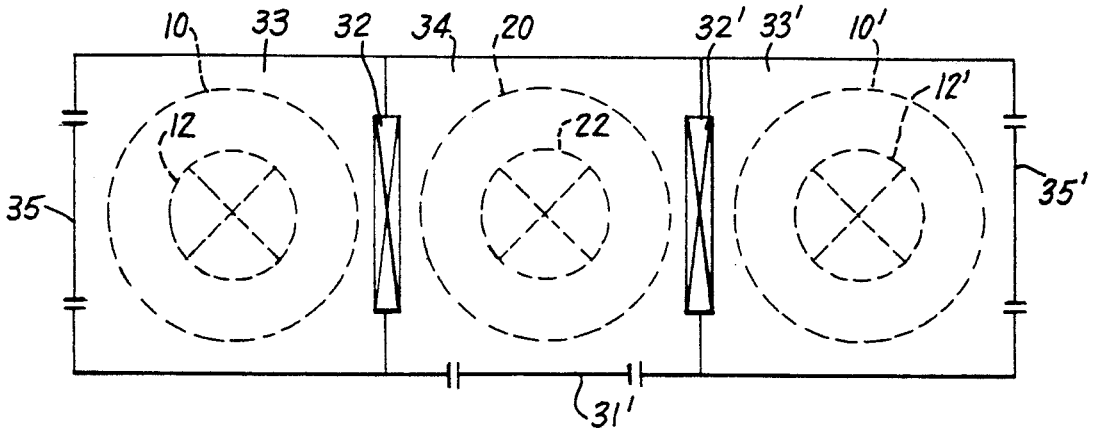
FIG. 4 is a schematic section in elevation of a third embodiment.

This is the case in the installation shown in FIG. 4. The lock is divided into three parts, 33, 34, and 33', by mold passage gates 32 and 32'. The middle part 34, opens to the outside via airtight door 31', an exit for cooled molds only. Side parts 33 and 33' can communicate with the outside by opening doors 35 or 35', respectively, both of which are entrances only for molds to be cast. The middle part 34 is surmounted by chamber 20 for casting only, and it can be isolated by mold passage gate 22. The side parts of the lock 33 and 33' are surmounted by chambers 10 and 10', respectively, both for preheating and degassing only. They, too, can be isolated by mold passage gates 12 and 12', respectively. With the explanations already made taken into consideration, the functioning of the installation illustrated by FIG. 3 is obvious, so it need not be discussed at length.

Before taking up a detailed description of an installation in accordance with the invention, and involving the following figures, it should be pointed out that it is possible to give the two chambers in FIGS. 2 and 3, 10 and 20, or the three chambers in FIG. 4, 10, 20, and 10', analogous dimensions, and to provide in chamber 10, or in chambers 10 and 10', liquid metal supply devices and cooling devices analogous to those in chamber 20, and which will be described in what follows. Chambers 10 and 10', normally only for preheating and degassing, then can at the same time, and like chamber 20, be used for preheating, degassing, casting, and cooling, when the cooling phase is rapid. There thus is available, as described, an installation in conformity with the invention and having its advantages of two or three installations in conformity with the earlier state of the art and capable of functioning independently of each other.

Figure 5:
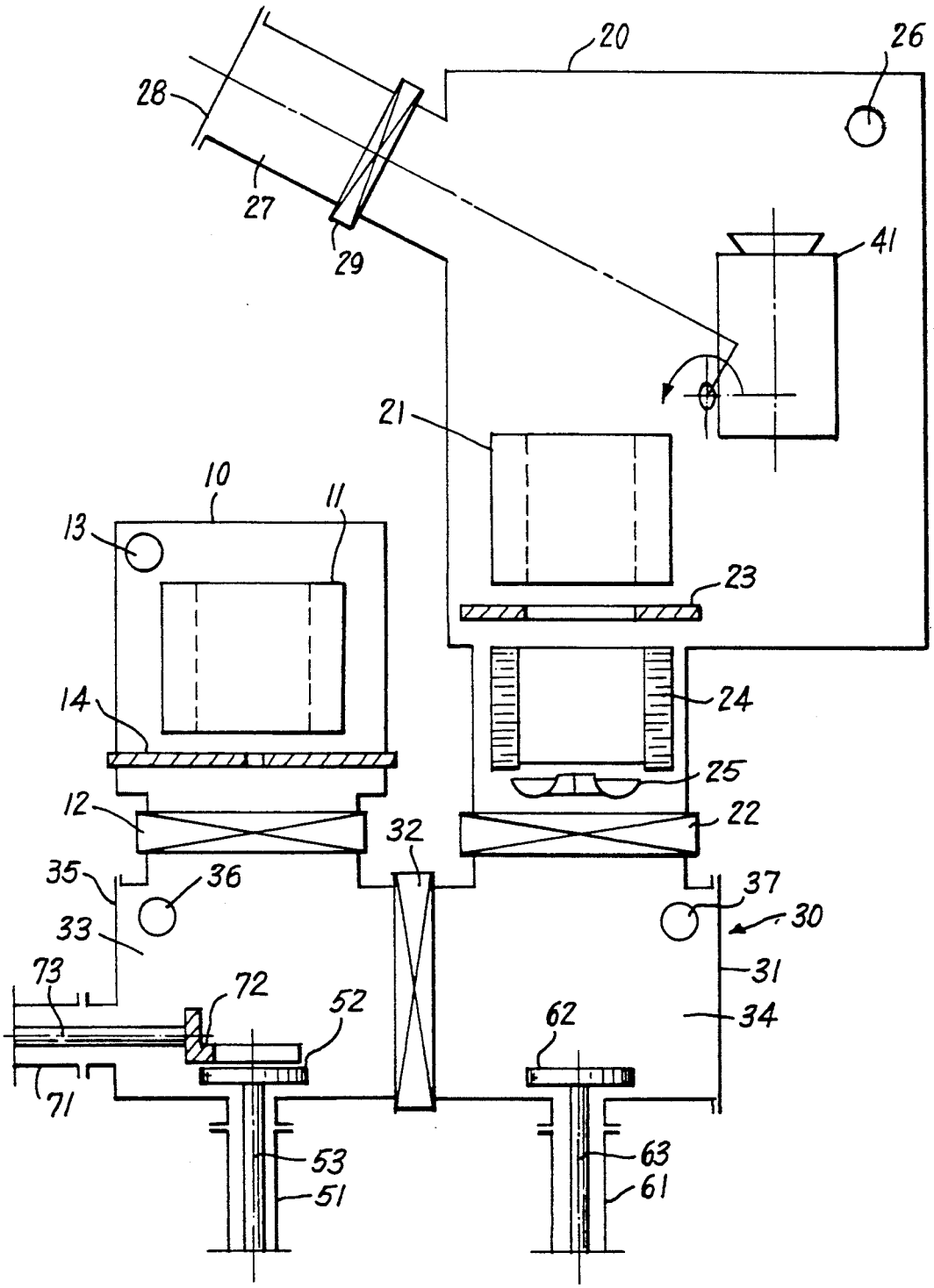
FIG. 5 is a vertical section of an installation conforming to the embodiment of FIG. 2.

To be considered now in FIG. 5, which shows in more detail an installation that conforms, in its manner of realization, to FIGS. 2 and 3. For purpose of facilitating examination, the drawing does not show, with certain exceptions, the components, mention of which is unnecessary to an understanding of the functioning of the installation, such as, for example, the electric wiring, the airtight joints, the surveillance ports, the pyrometer ports, the piping and jackets for circulation of water, etc.

Preheating and degassing chamber 10, double-walled, made of noncorrosible steel (not shown), contains the preheating furnace 11, which is a bottomless cylindrical resistance furnace. Chamber 10 surmounts that part of lock 33 designed for the entrance of the molds, and can be isolated by baffle gate 12, located under furnace 11, and designed as the passage for the molds. Opening 13 is the entrance for a suction pipe connected to a vacuum pump, which is not shown.

Casting chamber 20 is also double-walled and contains heating furnace 21, the design of which is analogous to that of furnace 11. This chamber is alongside chamber 10, and surmounts the part of lock 34 from which the molds exit. The chamber can be isolated from this part of the lock by baffle gate 22, which is the mold passage. The said gate is located under furnace 21, and distant from it. In addition, along the path of the mold between furnace 21 and gate 22 are, from top to bottom, heat shield 23, an annular cooler 24, consisting of a cylindrical jacket through which water is circulated, and baffle 25, protecting gate 22 from splattering or falling metal during the casting process. A description of these three subassemblies will be included in what follows.

Casting chamber 20 is placed under vacuum by a suction pipe that terminates in the chamber at 26 and is connected to a vacuum pump, which is not shown.

The metal is melted in chamber 20 proper in tilting induction furnace 41, which can be charged through lock 27 fitted with a charge hole closed by airtight door 28, and which can be isolated from chamber 20 by cover gate 29. Furnace 41 is located with respect to lock 27 and furnace 21 in a manner such that it can be positioned by outside controls: vertically for the melt, extreme tilt for the end of the casting; and an intermediate tilted position for charging a new crucible, using means not shown.

Mold passage gate 32, which makes it possible to isolate either of the two parts 33 and 34 of the lock is a cover gate. As in FIG. 2, the two parts of the lock are closed by airtight doors 35 and 31, respectively. Vacuum is obtained by suction pipes that terminate at 36 and 37, respectively, in these parts of the lock.

The mold transfer means include:

- to transfer a mold from part 33 of the lock to inside furnace 11, and vice versa, a vertical hydraulic jack 51, the rod 53 of which carries table 52, the purpose of which is to support and center the mold being transferred;
- to transfer a mold from part 34 of the lock to inside furnace 21, and vice versa, a vertical hydraulic jack 61, the rod 63 of which carries table 62, the purpose of which is to support and center the mold being transferred, and to act as the cooling plate;
- to transfer a mold from part 33 of the lock, where the aforesaid mold is placed on table 52 in the low position, to part 34 of the lock, where the aforesaid mold is to be placed on table 62 in the low position, a horizontal jack 71, placed under door 35, and the rod 73 of which carries a fork 72, the purpose of which is to shift and center the mold.

Tables 52 and 62, as well as fork 72, will be described below. The presence of baffle 14 under furnace 11 is to be noted. As will be explained in what follows, this baffle, the opening of which allows the mold to pass, is closed when the mold and the support table are in the high position. Retraction of jack rod 53 releases table 52, which remains in place on the baffle, and retraction of the jack rod continues so gate 12 can be closed.

Explanations with respect to the functioning of the installation in FIG. 5 have already been offered with reference to FIG. 2, so will not be repeated here. All that will be included hereinafter as purely indicative will be some values for operational parameters:

- in parts 33 and 34 of the lock: primary vacuum better than $10^{-2}$ torr; the mold introduced into part 33 having preheated in air to 1100° C.;
- in preheating and degassing chamber 10: heating of the mold 1300° C. under $10^{31\ 4}$ torr;
- in casting chamber 20: stabilization of the mold temperature at 1500° C. under an absolute pressure less than $10^{-4}$ torr; the aforesaid temperature in principle being equal to the alloy superheat temperature in furnace 41 prior to casting.

Opening door 31, or door 35, results in reestablishing the pressure prevailing in the corresponding part of the lock at a value close to atmospheric pressure. This is done by admitting argon through opening 37 or 36.

The durations of the stay of the molds in chambers 10 and 20, and of the controlled cooling phase during the slow descent of a cast mold through annular cooler 24, obviously depend on the shape of the parts, the alloy used, and the desired structure.

Figure 6:
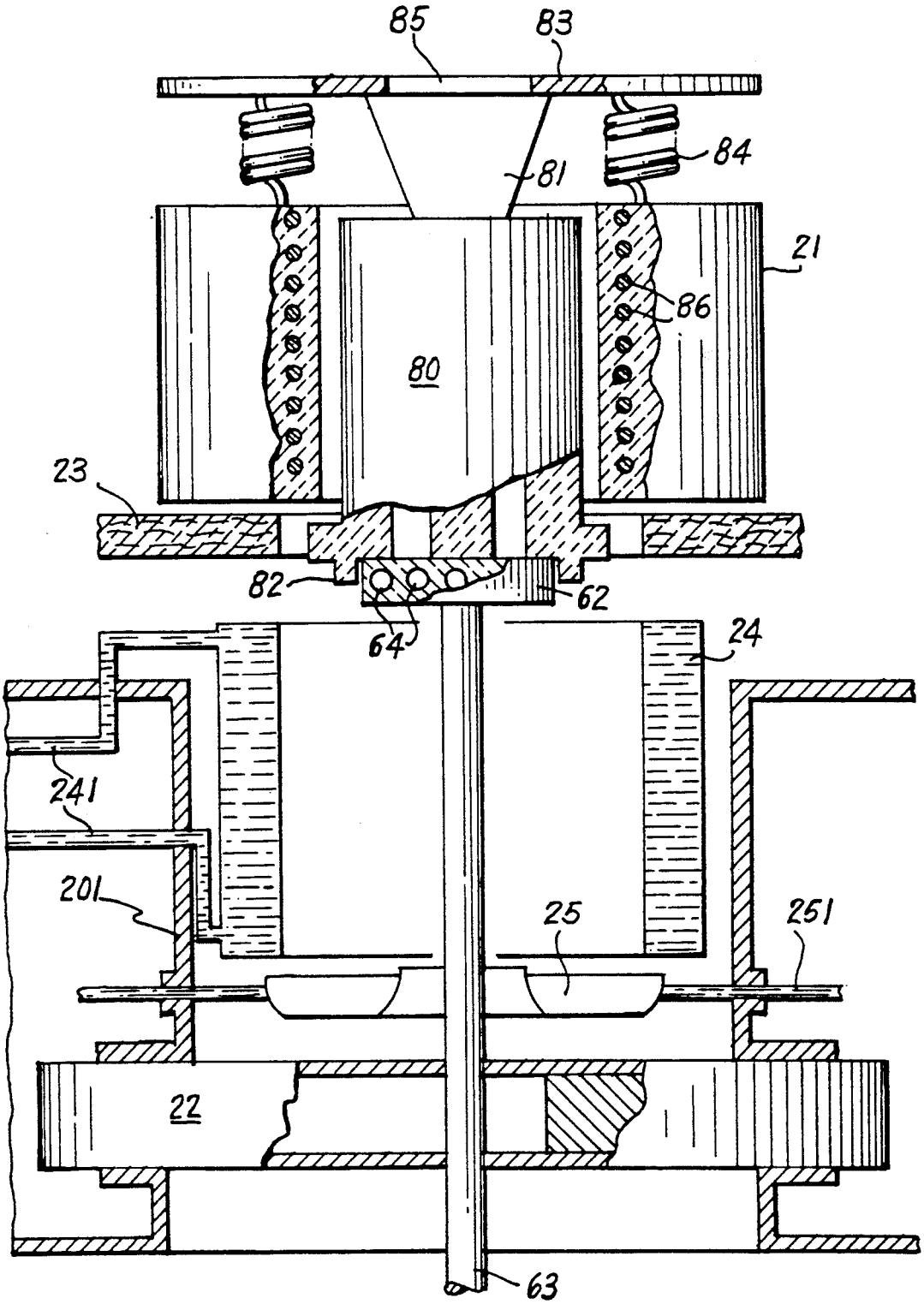
FIG. 6 is a vertical section, more detailed, of the subassemblies of the aforesaid installation permitting realization of controlled solidification.

FIG. 6 will now be considered. This figure represents, in particular, a vertical section of temperature maintenance furnace 21, heat shield, 23, annular cooler 24, receptacle 25, and plate 62, already mentioned with reference to FIG. 5.

Furnace 21 is a bottomless, electric resistance 86 furnace, in which the mold 80, surmounted by its sprue cup 81, is set when plate 62, carried by rod 63, is in the high position. The baffle of gate 22 then is open.

Plate or table 62, of known type, is a thick, heavy copper plate with channels 64, for the circulation of water. The water supply is through a flexible pipe, not shown. Note that the base of mold 80 has an annular rim 82, the inside periphery of which ensures centering the mold on plate 62, and the outside periphery of which is used, as will be seen in what follows, to ensure seizure of the mold by the fork of the lateral push-rod 72 (FIG. 5). To be noted as well is the presence of a flexible return clamping device ensuring the application of mold 80 against plate 62 when the latter is in the high position. The clamping device consists of plate 83, returned by traction springs 84, against furnace 21, with which they are integral. Sprue cup 81 pushes back plate 83, in which there is an outlet hole 85. Plate 83 have two functions. It holds mold 80 against plate 62, and prevents its rising (when the mold cavities are open at the bottom, as in the case in the figure) under the action, in particular, of the increase in hydrostatic pressure as a result of the accidental spreading of the layer of cast metal between the mold and the plate, and at the same time protects furnace 21 against spattering metal in the event of a casting accident.

The ring shield 23, made of an insulating material, is installed between furnace 21 and annular cooler 24. It slows heat exchanges between the two and divides the lower part of casting chamber 20 into two zones, one hot, the other cold, clearly separated.

Cooler 24 is a water jacket of known type. Circulation of water is provided by two pipes 241, that pass through the wall 201 of chamber 20.

Receptacle 25, the section of which is a toroidal-shaped cup, is divided into two sectors, the lips of which overlap to permit its removal to outside the cylindrical zone of the mold passage and of the plate by an outside mechanism which has been symbolized by jack rods 251. Closed, it protects the mechanism of baffle gate 22 against accidental spills of metal that can occur at the base of mold 80. The baffle of gate 22 is shown in the open position.

Once mold 80 has been cast, the two halves of receptacle 25 are swung clear of each other to permit the descent of the mold and its cooling. As soon as the descent is complete, gate 22 is closed to ensure the necessary isolation for extraction of the mold, the two halves of receptacle 25 remain apart to permit the next introduction of a new preheated and degassed mold after gate 22 is once again opened.

Without intending to belabor the point, it is understood that if the different subassemblies described are controlled manually, it is quite easy for a specialist to design safety devices that will prohibit the performance of certain phases if others have not been performed. It is, for example, desirable to prevent the closing of gate 22 when plate 62 is not in the low position, and to prohibit the descent of the plate when the two parts of receptacle 25 have not been swung clear of each other.

It is equally easy to automate the entire cycle by controlling all its phases, and all parameters of the operation, by using a microcomputer.

Figure 7:
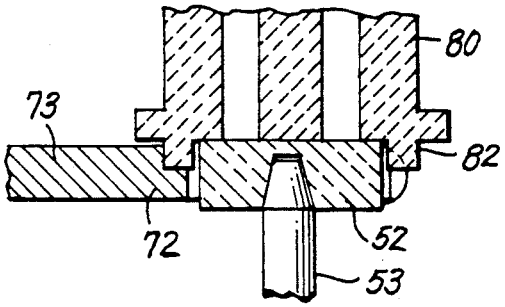
FIG. 7 is a fragmentary vertical section of a detail of the device for the horizontal transfer of the mold in the aforesaid installation.
Figure 8:
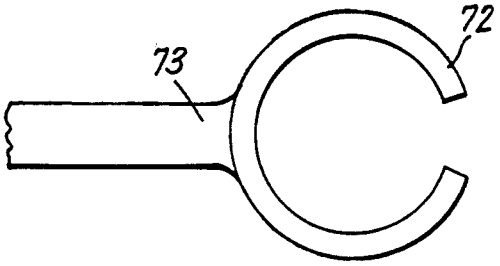
FIG. 8 is a top view of the device for horizontal transfer of the mold shown in FIG. 7.

FIGS. 7 and 8 will now be considered. FIG. 7 shows the lower part of mold 80 in place on table 52, supported by rod 53 (FIG. 5) of mold transfer jack 51 in preheating and degassing chamber 10. Table 52 is made of graphite. The diameter of this table is the same as that of plate 62 (FIG. 6), thus ensuring the centering of the modl by rim 82, already described. The tapered end of jack rod 53 fits into a tapered recess bored in the table. The taper is broad enough for easy separation. So far as fork 72, which is carried by jack rod 73 (FIG. 5) is concerned, it is made so as to ensure that the outer periphery of rim 82 will grip and center the base of mold 80, as is shown in FIG. 8.

Returning now to FIGS. 5, 6 and 7, and as has already been explained, baffle 14, when closed, supports plate 52 and mold 80 inside furnace 11 when rod 53 of jack 51 is retracted.

To extract the mold from furnace 11, and to transfer it on plate 62, rod 53 of jack 51 rises and seats in the tapered recess in table 52 and recenters it. Baffle 14 is open. The jack rod descends at the same time that fork 72 is positioned in the path of the mold. As soon as the mold makes contact with the fork, the latter recenters the mold and supports it with the outside of rim 82. The rod of jack 51, continuing to retract, carries along plate 52 whereas the mold and the fork are freed for the transfer. This latter is accomplished, and is terminated, with the positioning of the mold over plate 62.

Plate 62, as it rises under the control of jack 61, raises the mold and recenters it inside rim 82 so it can be transported into furnace 21 at the same time that fork 72 is released so it can resume its initial position, where it remains available to effect a new transfer.

We claim:

1. A foundry installation for directional solidification of metal parts with an oriented structure, comprising: a first airtight chamber for casting and fitted with atmosphere control means, a mold heating furnace located in said first chamber, means for casting an alloy located in said first chamber, a lock chamber for the introduction and extraction of the mold and communicating with the outside via a first opening in the lock chamber, which is fitted with a first airtight door, and with the said first chamber via a first mold passage opening that can be sealed off by a first airtight gate controlled from the outside, first transfer means, controlled from the outside for transferring through said mold passage opening a mold from the lock chamber to the interior of a mold heating furnace, and vice versa, characterized by the fact that it comprises, in addition, at least a second airtight chamber for preheating a mold and, as occasion warrants, to degas them, and fitted with atmosphere control means, a mold preheating furnace located in the said second chamber, the latter communicating with the lock chamber via a second mold passage opening that can be sealed by a second airtight gate controllable from the outside, second transfer means controlled from the outside for transferring a mold through the said passage opening from the lock chamber to the interior of said preheating furnace, and vice versa.

2. A foundry installation in accordance with claim 1, characterized by the fact that the lock includes a third mold passage opening sealable by a third airtight gate for dividing the lock chamber into two parts, namely, one part communicating with the first, or casting, chamber via the first mold passage opening, and the other part communicating with the second, or preheating, chamber via the second mold passage opening.

3. A foundry installation in accordance with claim 1 characterized by the fact that the first mold transfer means comprise a mold carrier plate cooled by the circulation of a liquid coolant.

4. A foundry installation in accordance with claim 1 characterized by the fact that the installation also comprises an annular cooler located in the path of the mold, between the mold heating furnace and the first passage opening.

5. A foundry installation in accordance with claim 1 characterized by the fact that the alloy casting means located in the first chamber consist of an alloy smelting furnace.

6. A foundry installation in accordance with claim 1 characterized by the fact that the first and the second chambers surmount the lock, the first and the second mold passage openings being horizontal, the heating furnace and the preheating furnace being bottomless annular furnaces located respectively above the aforesaid openings, and in which the first and second mold transfer means introduce the molds via the bottom.

7. A foundry installation in accordance with claim 5 characterized by the fact that the smelting furnace is a tilting furnace controlled from the outside, and by the fact that the first chamber contains a lock for charging and discharging the smelting furnace, and is insulated from the aforesaid chamber by an airtight gate.

8. A foundry installation in accordance with claim 6, characterized by the fact that the first mold transfer means consist of a first vertical jack, the rod of which supports a first mold carrier table.

9. A foundry installation in accordance with claim 8, characterized by the fact that the aforesaid mold carrier table consists of a plate cooled by the circulation of a liquid coolant.

10. A foundry installation in accordance with claim 6 characterized by the fact that the second transfer means includes a second vertical jack, the rod of which supports a second mold carrier table.

11. A foundry installation in accordance with claim 10 characterized by the fact that it includes in addition third transfer means controlled from the outside to raise a mold from the second carrier table and place it on the first carrier table when the first and second jacks are in the low position.

12. A foundry installation in accordance with claim 8 characterized by the fact that the bottom of each mold, being made with a circular rim, the diameter of each carrier table is slightly smaller than the inside diameter of the aforesaid rim to permit the recentering of the mold by each table.

13. A foundry installation in accordance with claim 11 characterized by the fact that said third mold transfer means comprise a horizontal jack, the rod of which carries a horizontal fork for gripping the mold, and by the fact that the outside diameter of the rim of the mold being less than the smallest transverse dimension of the aforesaid mold, the base of the aforesaid fork being a half-ring, the upper part of the section of which has an inside diameter smaller than the aforesaid smallest transverse dimension, and slightly larger than the outside diameter of the rim such that by the use of the three jacks the aforesaid fork will lift the mold from the second table while recentering it in the outside periphery of the rim when the second jack reaches the low position and place it on the first table when the first jack begins to move to the low position.

14. A foundry installation in accordance with claim 10 characterized by the fact that it includes in addition a baffle located between the preheating furnace and the second gate, the aforesaid baffle when open providing passage for the second table, and when closed providing passage for the rod of the second jack, while stopping the table, and by the fact that the table can be separated from the jack such that when in the open position the baffle allows the mold and table to rise into the furnace, and when in the closed position stops the mold and the table during the descent of the jack and supports the mold in the furnace on the table.

15. A foundry installation, for casting metal parts with an oriented structure by directional solidification, comprising an airtight chamber for casting and fitted with atmosphere control means, a bottomless cylindrical vertical axis furnace located in said chamber to heat a mold, means for casting the alloy, also located in said chamber, a lock chamber for introducing and extracting a mold, located below said chamber and with which it communicates via a horizontal mold passage opening located below the furnace and sealable by a gate controlled from the outside, and means for transferring a mold from a lock chamber to the interior of the furnace, and vice versa, said means being comprised of a vertical jack, the rod of which supports a mold carrier table for introducing the latter into the furnace through the bottom and which includes resilient means arranged to maintain the mold tight against the table when the aforesaid mold is inside the furnace.

16. A foundry installation in accordance with claim 15 characterized by the fact that said flexible return means include a plate surmounting the furnace and attached to the latter of traction springs, the mold pushing said plate upwardly when the mold is in place in the furnace, there being a hole in said plate, the purpose of which is to clear a mold tap hole.

17. A foundry installation for casting metal parts with an oriented structure by directional solidification, comprising an airtight chamber for casting and fitted with atmosphere control means, a bottomless cylindrical vertical axis furnace located in said chamber and designed to heat a mold, means for alloy casting, also located in said chamber, a lock chamber for introducing and extracting a mold, located below said chamber and with which it communicates via a mold passage opening located below the furnace and sealable by a gate controlled from the outside, and means for transferring a mold from the lock into the interior of the furnace, and vice versa, consisting of a vertical jack, the rod of which supports a mold carrier table to introduce the mold into the furnace through the bottom, characterized by the fact that it includes in addition a receptacle in the shape of an annular cup located between the furnace and the gate and separable into two sectors to permit, by means of an outside mechanism, its extraction so as to permit the passage of the mold and its table, said receptacle, when in place, protecting the gate against metal splashes or spills that can occur during casting.

18. A foundry installation for casting metal parts with an oriented structure by directional solidification, comprising an airtight chamber for casting and fitted with atmosphere control means, a bottomless cylindrical vertical axis furnace located in said chamber to heat a mold, means for introducing a mold through the bottom into the interior of the furnace and for extracting the mold, and an annular cooler located below the furnace and providing a passage for the mold during its introduction and extraction, characterized by the fact that it includes a heat insulating shield with a mold passage hole located between the furnace and the cooler.

* * * * *

UNITED STATES PATENT AND TRADEMARK OFFICE

CERTIFICATE OF CORRECTION

PATENT NO. : 5,168,916

DATED : December 8, 1992

INVENTOR(S) : Doriath et al.

It is certified that error appears in the above-identified patent and that said Letters Patent is hereby corrected as shown below:

Col. 2, line 26, delete "mods" and insert --molds--.

Col. 7, line 52, delete "$10^{314}$" and insert --$10^{-4}$--.

Col. 9, line 7, delete "modl" and insert --mold--.

Col. 11, line 37, delete "of" and insert --by--.

Signed and Sealed this

Ninth Day of November, 1993

Bruce Lehman

*Attest:*

BRUCE LEHMAN

*Attesting Officer*

*Commissioner of Patents and Trademarks*